United States Patent [19]

Vignon

[11] 4,364,223

[45] Dec. 21, 1982

[54] PROCESS FOR PRODUCING A COMBINATION YARN

[75] Inventor: Louis Vignon, Geneva, Switzerland

[73] Assignee: Heberlein Hispano SA, Geneva, Switzerland

[21] Appl. No.: 72,593

[22] Filed: Sep. 5, 1979

[30] Foreign Application Priority Data

Sep. 5, 1978 [CH] Switzerland ..... 9333/78

[51] Int. Cl.[3] ..... D01H 1/135; D02G 3/36

[52] U.S. Cl. ..... 57/5; 57/401; 57/411

[58] Field of Search ..... 57/5, 6, 58.89–58.95, 57/401, 411, 403

[56] References Cited

U.S. PATENT DOCUMENTS 4,107,909 8/1978 Fehrer et al. ..... 57/5

4,202,162 5/1980 Vignon ..... 57/58.89

*Primary Examiner*—John Petrakes

*Attorney, Agent, or Firm*—William R. Hinds

[57] ABSTRACT

The object of the process is to produce a yarn comprising a core of continuous filament and a sheath of staple fibers. The staple fibers are delivered to a suction surface comprising a perforated collecting surface exposed to relative suction in a suction zone, the fibers being conveyed in a current of air moving virtually at right angles to the surfaces of two counter-rotating friction discs having narrowly spaced opposing faces defining a gap. From the suction zone, the staple fibers are transferred, generally at right angles to the axis of the current of air, into the gap. The continuous filament is united with the staple fibers in the suction zone, and both components are twisted in the gap between the counter-rotating friction discs.

7 Claims, 4 Drawing Figures

PROCESS FOR PRODUCING A COMBINATION YARN

FIELD OF THE INVENTION

The instant invention relates to a process for producing a combination yarn comprising a core of continuous filament and a sheath of staple fibers.

BACKGROUND AND SUMMARY OF THE INVENTION

The production of combination yarns comprising a core of continuous filament and a sheath of staple fibers is well known. The disadvantage of the known production processes is that their relatively low production rates make them uneconomical.

In commonly assigned U.S. application Ser. No. 959,190, filed Nov. 8, 1978, now U.S. Pat. No. 4,202,162, issued May 13, 1980, there was proposed a process for spinning textile fibers whereby the fibers are delivered to a perforated collecting surface having a limited suction zone in a current of air moving virtually at right angles to the surfaces of two friction discs. From the suction zone the fibers are passed at right angles to the direction of the air current into the gap between the narrowly spaced counter-rotating friction discs, such that the opposing faces impart a twist to the stable fiber.

Suprisingly, it has now been found that this general process is eminently adaptable to the production of combination yarns comprising a core of continuous filament and a sheath of staple fibers.

Accordingly, the instant invention is directed to a process for producing a combination yarn by the previously mentioned working procedure, featuring the marriage of a continuous filament with the staple fibers in the suction zone and the twisting of both components in the gap between the friction discs.

A basic advantage of the process according to the instant invention is that, when compared with known processes, it achieves essentially higher production rates and therefore increased efficiency. Furthermore, it improves the sheathing of the continuous filament with the staple fibers. The fact that true twist is not imparted to the continuous filament at the twisting stage, but only false twist, implies that the continuous filament is always located at the center of the combination yarn.

When continuous filaments of synthetic thermo-plastic material are employed, the false twist may be heat-set before being united with the staple fibers, whereby the continuous filament is permanently textured, thereby imparting elasticity to the combination yarn.

The process of the invention will be described in detail in conjunction with the appended drawings, which are schematic representations of the process and the apparatus used therein.

DETAILED DESCRIPTION OF THE PREFERRED EMBODIMENTS

Figure 1:
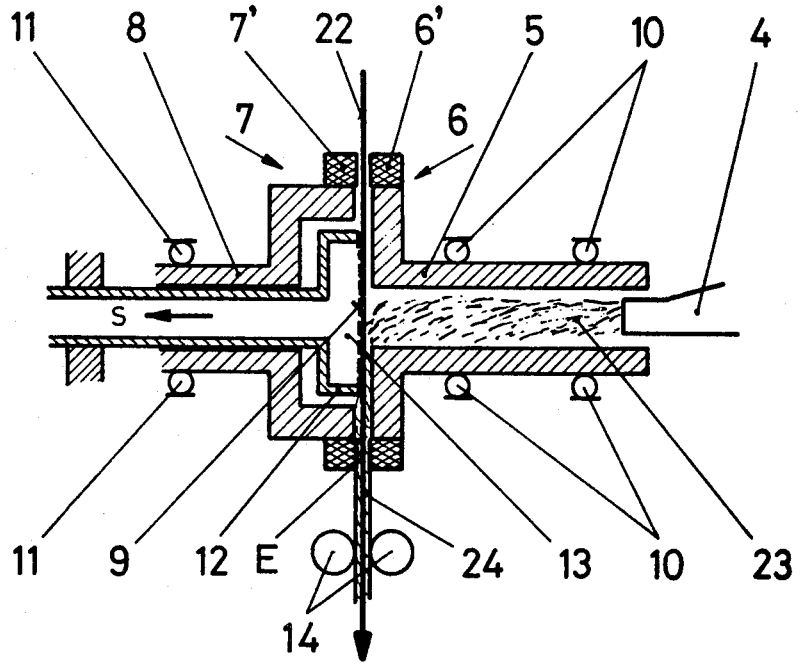
FIG. 1 is a schematic longitudinal section of a device for carrying out the process.

Referring to FIG. 1, there is shown the end of a guide duct 4 engaging one end of hollow shaft 5, at whose opposite end is mounted the friction disc 6 containing a central passage. Opposite the friction disc 6, and narrowly spaced therefrom, is a second friction disc 7 also containing a central passage, mounted at one end of a second hollow shaft 8. The areas 6', 7' comprising the edges of the friction discs 6, 7 are preferably made of polyurethane. The hollow shafts 5, 8 are pivoted in ball-bearings 10, 11. Located within the hollow shaft 8 is a fixed suction element 12 connected to a source of negative pressure, not shown, its generally funnel-shaped end holding a perforated collecting surface 9 having a suction zone 13. Passing at right angles to the direction of the current of air carrying the staple fibers 23, the continuous filament 22 is delivered, between the pair of friction discs, 6, 7, to the suction zone 13 to which the staple fibers 23 are conveyed by the guide duct 4. Following this operation, the continuous filament 22 and the staple fibers 23 are passed, in their combined state, at right angles to the direction S of the current of air into the gap E between the friction discs 6, 7, serving to impart the twist, the combination yarn 24 being drawn off by the pair of rolls 14.

The surfaces of the friction discs 6, 7 facing one another are preferably not completely parallel, which means that they are more narrowly spaced on the side closest to the draw-off rolls, thereby assuring improved frictional contact between the edges of the discs and the fiber material.

Figure 2:
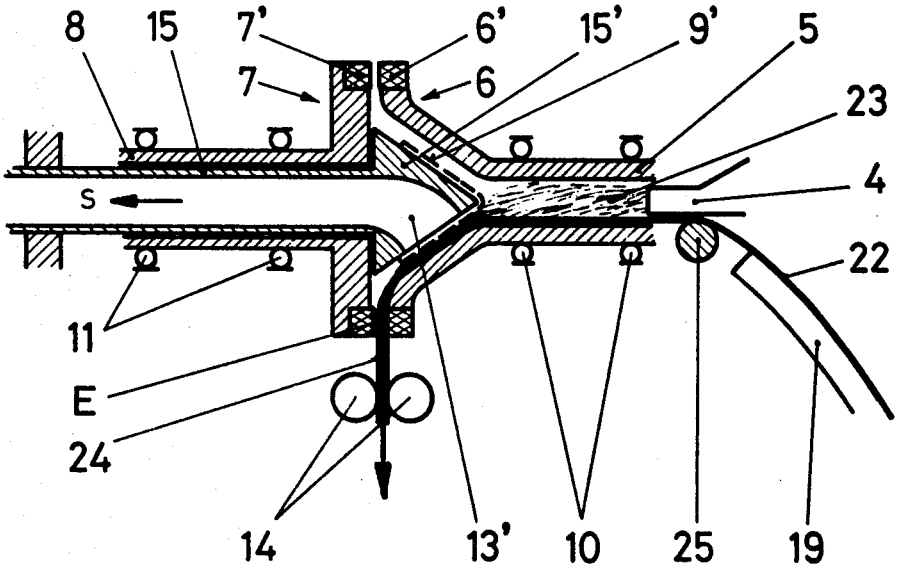
FIG. 2 illustrates a variant of the longitudinal section of the device as set out in FIG. 1.

As illustrated in FIG. 2, representing a variant of the device of FIG. 1, the hollow shaft 8 contains a fixed suction element 15 having a suction zone 13' and a tapered end-piece 15' on which the collecting surface 9', also tapered, is located. A continuous filament 22 of synthetic thermoplastic material is introduced into the hollow shaft 5 via a contact heating element 19 and the guide roll 25, passing with the staple fibers 23 to the suction zone 13' and hence into the gap E between the friction discs 6, 7, where both components are twisted, thereby forming the combination yarn 24. The heating element 19 is used to set the false twist imparted to the continuous filament 22, thereby producing a textured yarn having stretch properties and in turn increasing the elasticity of the combination yarn 24. Needless to say, the device as illustrated in FIG. 2 can also be used without the heating element 19.

Figure 3:
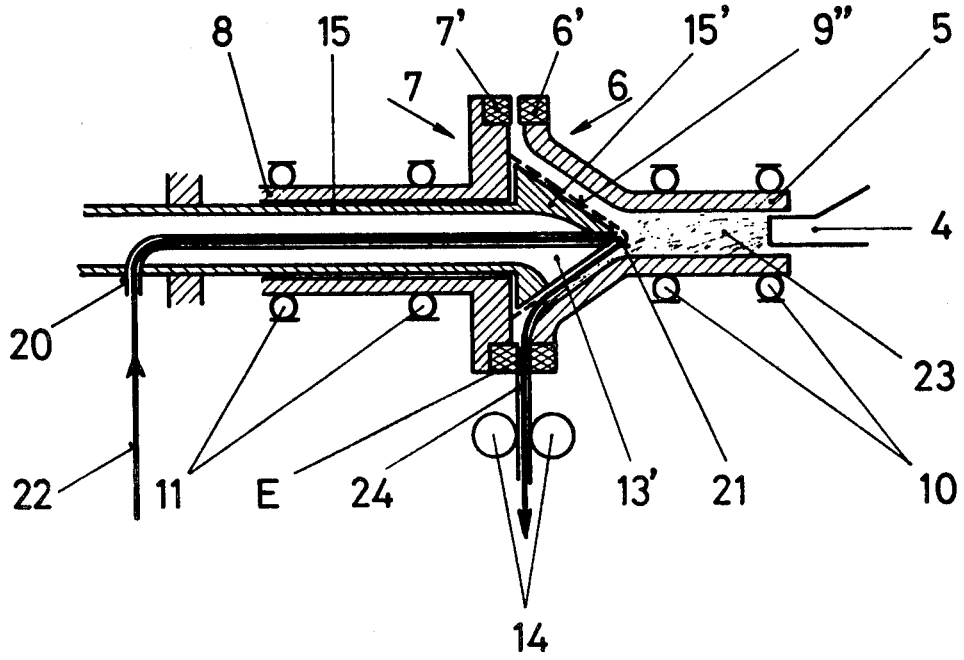
FIG. 3 illustrates a variant of the longitudinal section of the device as set out in FIG. 2.

As shown in FIG. 3, representing a variant of the previously described devices, the free ends of the tapered collecting surface 9'', located closely adjacent the suction element 15', are connected to the friction disc 7, thereby assuring that the collecting surface 9'' describes the same rotary movement as the hollow shaft 8, and that the suction zone 13' is not always presented the same segment of the collecting surface 9''. The hollow shaft 8 contains an axially tubular duct 20 leading to an opening 21 in the tip of the tapered collecting surface 9'. The continuous filament 22 is conveyed through the duct 20 and delivered to the suction zone 13' together with the staple fibers 23, and hence to the gap E between the friction discs 6, 7, where both components are twisted, thereby forming the combination yarn 24.

Figure 4:
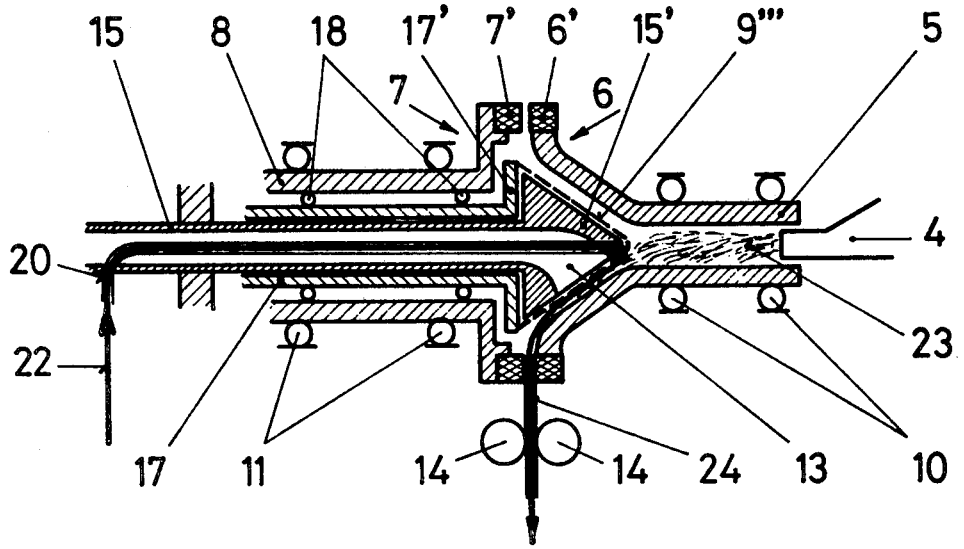
FIG. 4 illustrates a variant of the longitudinal section of the device as set out in FIG. 3.

As shown in FIG. 4, illustrating a further variant of the device shown in FIG. 3, the hollow shaft 8 contains a co-axial cylindrical support 17 which is hollow and rotatable in bearings 18. The support 17 is provided with a disc-shaped edge 17' to which the free ends of the tapered collecting surface 9''' are connected. Thus the rotation of the support 17 and the collecting surface ''' can be commenced or varied reasonably rapidly, regardless of the rotational speed of the friction discs 6, 7, thereby assuring that the suction zone 13 is not always presented the same segment of the collecting surface 9'''.

The disclosure of said commonly assigned U.S. application Ser. No. 959,190 is hereby incorporated herein by reference.

Having thus described and illustrated preferred embodiments of my invention in the manner required by the Patent Statutes, I claim:

1. A process for the production of a combination yarn comprising a core of continuous filament and a sheath of staple fibers, comprising conveying the staple fibers in a current of air to a suction surface comprising a perforated collecting surface exposed to relative suction in a suction zone, the current of air moving at generally right angles to the surfaces of two counterrotating friction discs having narrowly spaced opposing faces defining a gap located relatively radially outwardly of the axis of said current of air, transferring the staple fibers from the suction zone generally at right angles to the axis of said current of air and into said gap so as to impart twist to the fibers, and uniting a continuous filament with the staple fiber in the suction zone so as to be twisted therewith in said gap to form a yarn comprising a core of continuous filament and a sheath of staple fibers.

2. A process as claimed in claim 1 wherein the continuous filament is delivered between the two friction discs to the suction zone, at right angles to the axis of the current of air carrying the staple fibers.

3. A process as claimed in claim 1 wherein the continuous filament is delivered to the suction zone with the staple fibers in the direction of the current of air.

4. A process as claimed in claim 1 wherein the continuous filament is delivered to the suction zone through a tubular duct contrary to the current of air carrying the staple fibers.

5. A process as claimed in claim 1 wherein the continuous filament is of a synthetic thermoplastic material.

6. A process as claimed in claim 5 further including heat-setting of the false twist imparted to the continuous filament in the gap between the friction discs.

7. A process as claimed in claim 1 wherein said suction zone is substantially encompassed by said discs.

* * * * *